United States Patent [19]

Ohnishi

[11] 4,252,157

[45] Feb. 24, 1981

[54] AUTOMATIC BUNDLING APPARATUS

[75] Inventor: Fukuji Ohnishi, Hyogo, Japan

[73] Assignee: Takigawa Kogyo Co., Ltd., Hyogo, Japan

[21] Appl. No.: 2,020

[22] Filed: Jan. 9, 1979

[51] Int. Cl.[3] ..... B21F 15/04

[52] U.S. Cl. ..... 140/93 A; 140/93.6; 140/119

[58] Field of Search ..... 74/70, 84 R, 710.5; 100/4, 26, 31; 140/93 A, 93.6, 57, 115, 118, 119, 122, 149

[56] References Cited

U.S. PATENT DOCUMENTS

| | | | |
|---|---|---|---|
| 977,673 | 12/1910 | Oehring | 74/84 |
| 3,037,534 | 6/1962 | Brouse | 140/93.6 |
| 3,037,535 | 6/1962 | Linehan et al. | 140/115 |
| 3,052,394 | 9/1962 | Linehan et al. | 226/190 |
| 3,274,921 | 9/1966 | Hall | 100/4 |
| 3,387,556 | 6/1968 | Cranston et al. | 100/4 |
| 3,433,084 | 3/1969 | Steinke | 74/84 |
| 3,470,813 | 10/1969 | Nomm et al. | 100/31 X |
| 3,880,204 | 4/1975 | Sarff et al. | 140/93 A |

FOREIGN PATENT DOCUMENTS

| | | | |
|---|---|---|---|
| 1145581 | 3/1969 | United Kingdom | 100/31 |

*Primary Examiner*—Ervin M. Combs
*Attorney, Agent, or Firm*—Shapiro & Shapiro

[57] ABSTRACT

In an automatic bundling apparatus for bar steel, die steel, steel pipes, wire rods, etc., a power shaft and a twist shaft are disposed coaxially and a differential gearing mechanism is interposed between and coaxially with the power shaft and the twist shaft. The functions such as clamping of the bundling wire end, cutting of the wire and twisting of the wire which are the main operations in bundling are performed by the same hydraulic motor through the utilization of the differential gearing mechanism.

9 Claims, 8 Drawing Figures

AUTOMATIC BUNDLING APPARATUS

BACKGROUND OF THE INVENTION

1. Field of the Invention

This invention relates to improvements in a bundling apparatus for automatically bundling bar-like articles such as steel bars, wire rods, etc. by means of a bundling wire.

2. Description of the Prior Art

Briefly describing the construction and operation of the generally used bundling apparatus, it comprises a wire feeding mechanism for feeding a bundling wire from a supply source, a wire guide path for guiding and winding the fed wire around a material to be bundled, and a twist shaft for finally twisting together the opposite ends of the wire, and further comprises important components such as a sensing device for sensing the completion of feeding of a necessary length of wire, a cutting device for the bundling wire and a bending device for bending the opposite ends of the wire. Moreover, the steps performed by the above-described devices must be a series of associated steps progressing with time and therefore, for example, the bending device or the cutting device must be disposed so as to be driven by independent drive sources while, at the same time, a limit switch for instructing the initiation or stoppage of the drive and a relay or a cam device for interlocking the limit switch must be provided. This necessitates excess space and complicates the entire apparatus. There is, therefore, a great possibility of trouble in the apparatus. The system heretofore employed as the sensing device for sensing the completion of the feeding of the bundling wire is directed to the sensing of pressure imparted by the leading end of the wire to a stop or to sensing lateral pressure provided by the leading end of the wire contacting the stop which curvedly deforms the wire in the feeding path, and depends on a mechanical impulse caused by the wire. Such means does not always exhibit the expected mechanical impulse when the fed wire accidentally has a slight inadvertent bend for some reason or other, and cannot be called a reliable sensing device.

The present invention overcomes the disadvantages peculiar to the prior art apparatus and realizes a bundling apparatus in which independent drive sources and accessory instruments for controlling the starting and stoppage of these drive sources are simplified for the series of steps forming the bundling operation, to thereby effect a plurality of processes efficiently.

Further, the present invention provides a sensing device of higher reliability for sensing the completion of the feeding of the wire and which does not depend on a mechanical impulse.

SUMMARY OF THE INVENTION

In the bundling apparatus of the present invention, a power shaft is provided on a common axis on the extension of the axis of a twist shaft for the bundling wire and an outer structure is provided between and coaxially with the twist shaft and the power shaft.

A pair of opposed differential bevel gears with the common axis interposed therebetween are provided on the outer structure in a direction perpendicular to the common axis. A bevel gear at the end of the power shaft meshes with the differential bevel gear from one side thereof and a bevel gear at the end of the twist shaft meshes with the differential bevel gear from the other side thereof. The outer structure itself is supported for rotation about said common axis by a bearing provided outside the body thereof, and the power shaft and the twist shaft are supported for rotation about said common axis at positions proximate to the meshing bevel gears by said outer structure. Thus, the differential gearing is interposed between the outer structure and the power shaft and the twist shaft.

Means for angularly limiting and stopping the rotation of the outer structure is attached with respect to the outer structure, and means for bending and cutting the bundling wire is provided at the end of the outer structure which is adjacent to the twist shaft. Means for stopping the rotation of the twist shaft is attached with respect to the twist shaft, and two holes for passing therethrough the bundling wire are provided at the twist end of the twist shaft which is opposite from the bevel gear.

Further, bundling wire guide means including a sensing device for sensing completion of the winding operation of the bundling wire is disposed above the twist end of the twist shaft.

With such a construction, if the power shaft is rotated in a predetermined direction and the outer structure is held stationary by its stop means, the twist shaft rotates in the direction opposite to the direction of rotation of the power shaft due to the principle of the differential device, and if the outer structure is released and the twist shaft is held stationary by its stop means, the outer structure rotates in the same direction as the power shaft.

Thus, if the power shaft is moved upon sensing of completion of the winding operation of the bundling wire and the twist shaft is made stationary at this time, only the outer structure is rotated to cut and bend the distal ends of the bundling wire wound around a material to be bundled. When the outer structure is stopped after a limited angular rotation, the twist shaft is released from its stoppage and starts to rotate in the direction opposite to the direction of rotation of the power shaft and thus, the ends of the wire in the two holes are drawn out of these holes and twisted together. After the twist shaft has made a number of revolutions necessary for twisting together the wire ends, the power shaft is stopped from rotating and the ends of the wire twisted together are pushed down to terminate the bundling of the material to be bundled.

Thereafter, when the power shaft is started in the opposite direction, the outer structure is rotated in the same direction as the power shaft (in the direction opposite to the previous direction of rotation) and is stopped after a limited angular rotation. Thereupon, the twist shaft starts rotating and after a certain angular rotation, the twist shaft is stopped by its stop means, thus completing a cycle of bundling operation.

Moreover, the above-described series of processes can be accomplished by the movement of a single power shaft from a single drive source.

It is an object of the present invention to provide a bundling apparatus in which a series of main processes forming the bundling operation may be accomplished by a single power shaft system.

It is another object of the present invention to provide a bundling apparatus in which a single power shaft system includes a differential gearing device.

It is still another object of the present invention to provide a bundling apparatus in which accessory instruments for controlling the start and stop of the series of main processes are simplified.

It is yet still another object of the present invention to provide a bundling apparatus in which the sensing device for sensing the completion of feeding of the bundling wire is a highly reliable sensor which does not depend on a mechanical impulse.

These and other objects and advantages of the present invention will become apparent from the following detailed description taken in conjunction with the accompanying drawings.

DESCRIPTION OF THE PREFERRED EMBODIMENT

Figure 1:
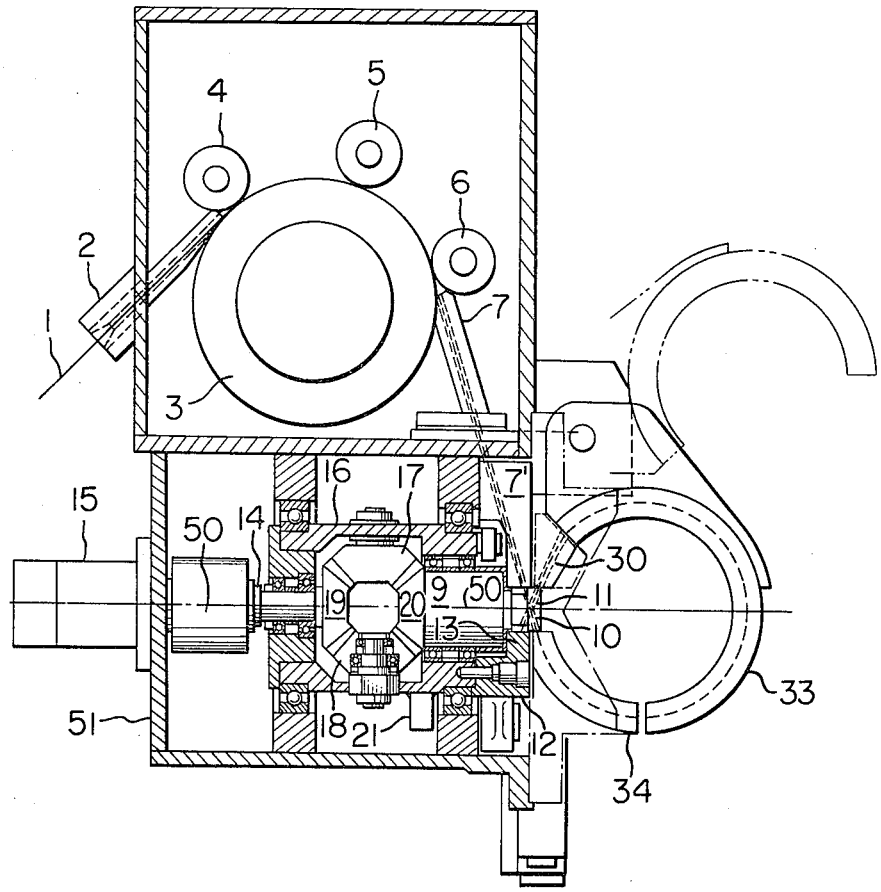
FIG. 1 is a partly cross-sectional front view of the bundling apparatus according to the present invention.
Figure 2:
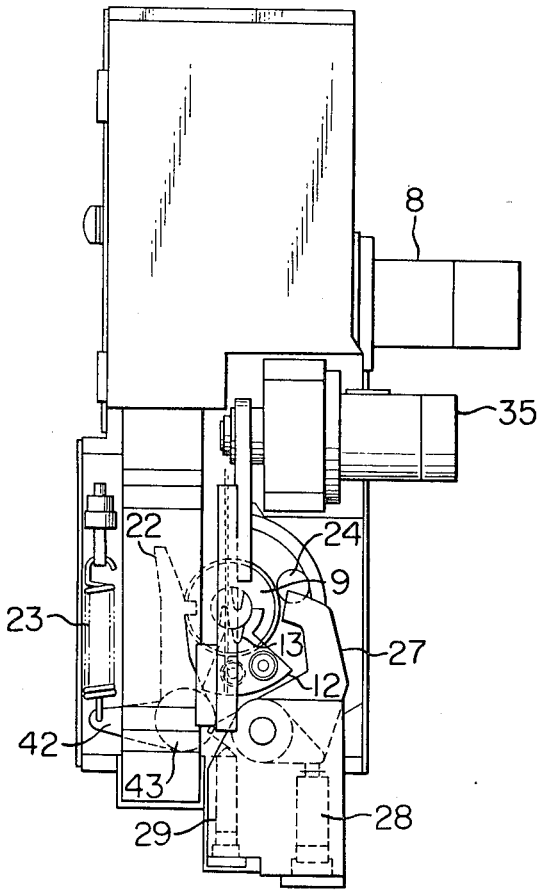
FIG. 2 is a side view of the bundling apparatus.

In FIGS. 1 and 2, a continuous wire 1 for bundling is fed via a guide 2 toward the peripheral groove of a feed pulley 3 and guided by pinch rollers 4, 5 and 6 to guides 7 and 7'. Designated by 8 is a feed motor which is operable by a sensing device to be described, to intermittently drive the feed pulley 3 in forward and backward directions. The leading end of the wire 1 having left the guide 7' passes through one of two holes, 10, formed in the end face opposite to the drive side end of a twist shaft 9 and is guided in the form of a loop and passes through another hole 11 so that the leading end of the wire is blocked against further advance by a recess 13 for stopping the leading end of the bundling wire formed in a cutter 12. Such construction is enlarged in FIGS. 3 and 4. In FIGS. 1 to 4, reference numeral 14 denotes a power shaft, and 15 a motor for driving the power shaft 14. Designated by 16 is an outer structure (in the present embodiment, it is cylindrical and referred to as the outer wheel) which is supported for pivotal movement about an axis 50 common to the axis of the power shaft 14 and the twist shaft 9, and a pair of opposed bevel gears 17, 18 are mounted on the inner side of the outer wheel. The bevel gears 17 and 18 respectively mesh with a bevel gear 19 provided at the end of the power shaft 14 and a bevel gear 20 provided at one end of the twist shaft 9, and these together constitute a differential gearing mechanism.

A sector stop 21 is provided on the outer periphery of the outer wheel 16, and a limit plate 36 (see FIG. 3) corresponding to the sector stop is secured to the housing 51 of the bundling apparatus. Thus, the outer wheel 16 is rotatable through a limited angle about the axis 50. A concave groove 39 is provided in the outer periphery of the twist shaft 9, and a stop 22 is provided with respect to the housing 51 of the bundling apparatus. The stop 22 is generally formed into an L-shape and a shaft 43 is provided on the bend of the L-shape so as to permit rotation, and the end of the lower arm 42 of the L-shape is pulled on by a spring 23. Thus, the stop 22 is normally urged against the twist shaft, and when the concave groove 39 of the twist shaft meets the claw 41 of the stop 22, the claw 41 enters the concave groove 39 to hold the twist shaft stationary. Therefore, if the power shaft 14 is rotated in a predetermined direction by the motor 15 and the outer wheel 16 is prevented from rotating by the abuttment of the sector stop 21 with the limit plate 36, the twist shaft 9 rotates in the direction opposite to the direction of rotation of the power shaft due to the principle of the differential gearing. If the outer wheel 16 is released by the sector stop 21 and the twist shaft 9 is stopped by the engagement between the concave groove 39 of the twist shaft 9 and the claw 41 of the stop 22, the outer wheel 16 rotates in the same direction as the power shaft. Thus, it becomes possible to cause, a plurality of functions in associated steps required in the bundling apparatus and continuous with time, to be continuously performed by a single power shaft. Designated by 23 is a spring for the stop 22, and 24 a roller for drawing out the stop 22 from the twist shaft 9. The roller 24 is loosely fitted on a shaft studded in the end face of the outer wheel 16 and when the counter-clockwise rotation of the outer wheel 16 in FIG. 4 is brought to an end by the abuttment of the sector stop 21 with the limit plate 36, the roller 24 comes into engagement with an upward extension 44 of the stop 22 to draw out the claw 41 of the stop from the concave groove 39 of the twist shaft 9 against the force of the spring 23 (FIG. 5D).

Figure 4:
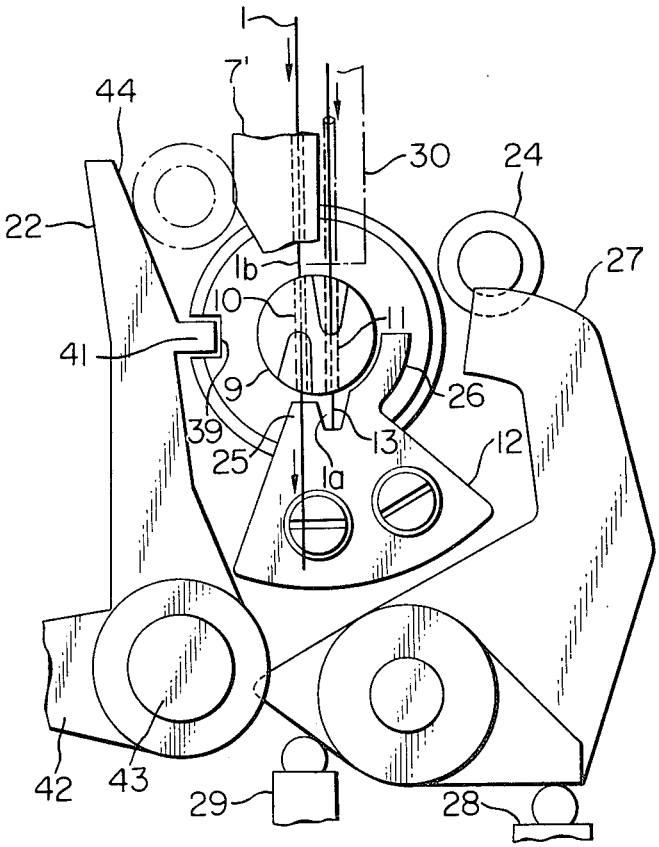
FIG. 4 is a side view corresponding to FIG. 3.

As best illustrated in FIG. 4, the cutter 12 is installed on the end face of the outer wheel 16 and is rotatable with rotation of the outer wheel 16 to cause the leading end 1a of the wire 1 held in the bundling wire end stopping recess 13 to be bent along the peripheral surface of the twist shaft 9 by a projected piece 25, while the cutter still continues to rotate. The cutting edge 26, which is also an extension of the cutter 12, cooperates with the guide 7', which functions as a fixed cutting edge, to cut the wire 1 at a portion which is to be the trailing end 1b of the wire 1 and at the same time, the trailing end 1b cut by the cutting edge 26 is bent along the peripheral surface of the twist shaft 9. Designated by 27 is a lever for pushing down the twisted portion of the leading and trailing ends of the wire 1 after twisting together by the rotation of the twist shaft 9. The alternate movements of push-down and return of the lever 27 may be imparted by change-over of the pressure oil fed into cylinders 28 and 29.

Figure 3:
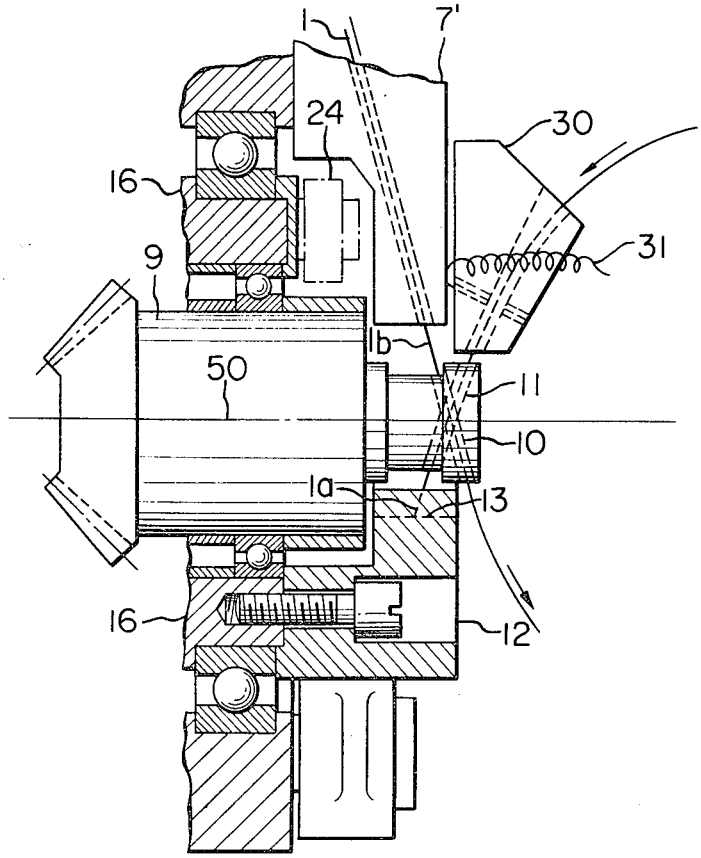
FIG. 3 is an enlarged cross-sectional view showing the components in the vicinity of the twist shaft of the bundling apparatus.

Designated by 30 in FIG. 3 is a guide provided with a sensing device for sensing the completion of the winding operation of the wire 1. In the course of the wire passageway formed through the guide 30, there is provided an electrical wire 31 forming an opposing terminal and a weak current may be passed therethrough to sense the variation in the conducted current resulting from the passage of the wire, thereby stopping the feed motor 8 for the feed pulley 3 and stopping the supply of the wire 1. Of course, a relay is interposed therebetween so as to effect the regulation of the timing such that the supply of the wire is stopped immediately after the leading end 1a of the wire 1 has come into the back of the recess 13. Designated by 33 is an opening-closing guide for winding the bundling wire, 34 a fixed guide and 35 a swinging motor for opening and closing the opening-closing guide 33.

The bundling operation effected by the apparatus of the present invention will now be described.

Description will first be made of the initial positions of the various parts of the bundling apparatus. The outer wheel 16 is in a position wherein the left end of the sector stop 21 is stationary and bears against the limit plate 36 (as clearly seen in FIGS. 5A and 4), and accordingly, the cutter 12 and the roller 24 are also in the positions shown in FIGS. 5A and 4. The twist shaft 9 is in an angular position wherein the two holes 10 and 11 at the end thereof face in the vertical direction to receive the leading end of the bundling wire paid away from the guide 7'. At the same time, the claw 41 of the stop 22 is engaged with the concave groove 39 of the twist shaft 9 to bring about the stationary position of the twist shaft. The motor is stopped. For the clear understanding of the apparatus of the present invention, the above described position of each part is referred to as the bundling cycle starting position.

However, for the completion of the bundling operation, the other operations must be described. In starting the bundling operation, the opening-closing guide 33 should be opened to the position as indicated by dots-and-dash line in FIG. 1, by the swinging motor 35. Next, a material to be bundled (not shown) is placed at a suitable position in proximity to the fixed guide 34. Subsequently, the swinging motor 35 is operated to close the opening-closing guide 33 and when the feed motor is started in the forward direction in response thereto, the wire 1, which has so far been held stationary with the leading end thereof cut at the lower end exit of the guide 7', is fed from the guide 7' with the rotation of the feed pulley 3, passes through one hole 10 at the end of the twist shaft 9 and is guided by the fixed guide 34 and the opening-closing guide 33 to wrap the material to be bundled, in a loop form. The wire then passes through a hole in the guide 30 into the other hole 11 at the end of the twist shaft 9. At this time, the wire passes through the weak current path formed by the electrical wire 31 to increase the current conducted therethrough and such variation in the current is sensed to stop the wire feed motor 8 at the appropriate time, with the leading end 1a of the wire 1 passing through the hole 11 into the recess 13 of the cutter 12.

Simultaneously therewith, the motor 15 is started to rotate the power shaft 14 in counter-clockwise direction as viewed in FIGS. 4, 5A, 5B, 5C and 5D. At this time, the outer wheel 16 and the twist shaft 9 are in the bundling cycle starting position as previously described. Therefore, rotation of the twist shaft 9 is stopped by the stop 22 while the outer wheel 16 is free to rotate in a counter-clockwise direction. Thus, the rotative drive of the power shaft 14 is transmitted only to the outer wheel 16. Moreover, in the embodiment shown, the rotational torque of the outer wheel 16 is increased to twice the rotational torque of the power shaft 14 and the outer wheel effects rotation in the same direction as the power shaft at half the rotational speed of the latter. Operation after the initiation of rotation of the outer wheel 16 will hereinafter be described by reference to FIGS. 5A, 5B, 5C and 5D.

Figure 5A:
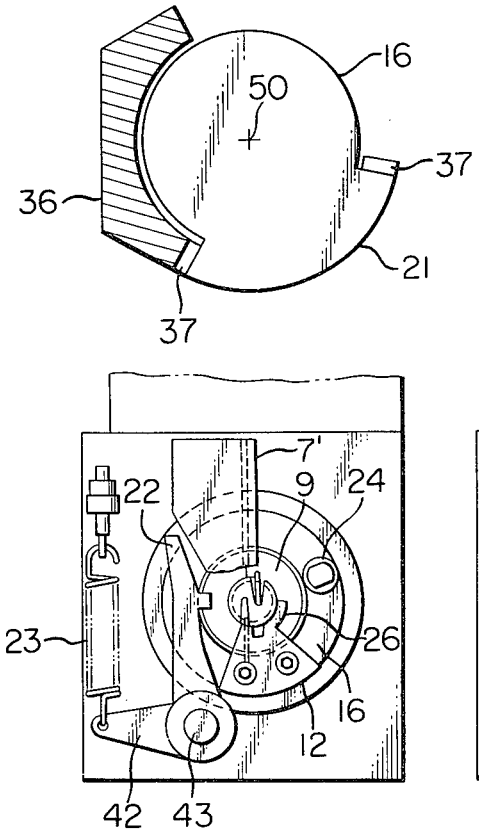
FIGS. 5A, 5B, 5C, and 5D illustrate the bundling operation.
Figure 5B:
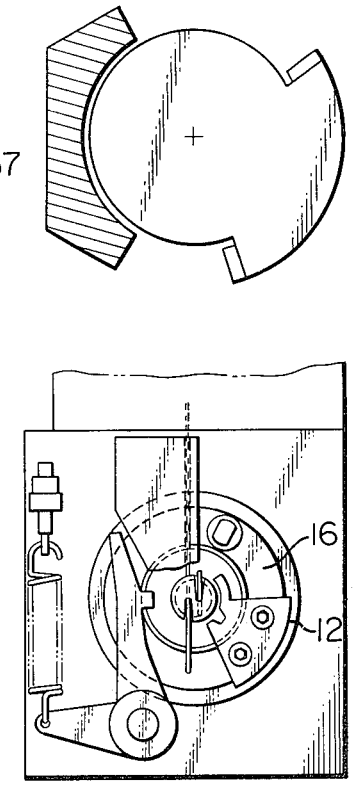
Figures 5C, 5D:
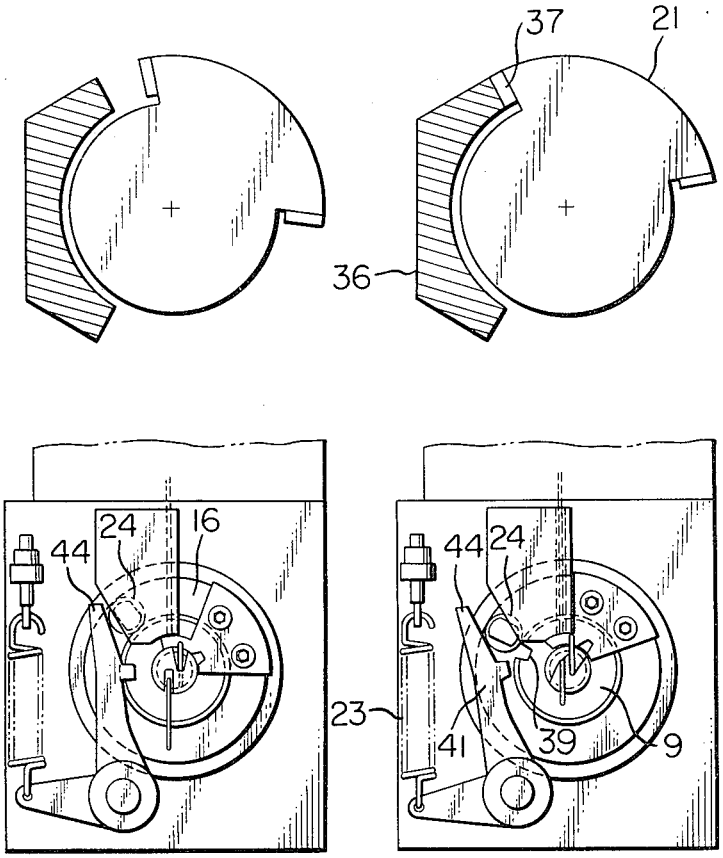

In FIG. 5, reference numeral 36 designates a limit plate secured to the housing 51 to limit the movement of the sector stop 21 secured to the outer wheel 16. Liners 37 are attached to the opposite ends of the limit plate to alleviate the shock occurring at each terminus of movement of the sector stop 21. As seen in FIG. 5A, initially, the twist shaft 9 is held stationary by the stop 22 while the outer wheel 16 is free to rotate in a counter-clockwise direction. Thus, the outer wheel 16 is rotated counter-clockwise with the rotation of the power shaft 14 so that the projected piece 25 on the cutter 12 strikes the leading end 1a of the wire. In the manner described above, the leading end 1a of the wire is bent by the projected piece 25 and the outer wheel further continues to rotate to the position as shown in FIG. 5B. This rotational position is detected by a detector means and the detection signal is transmitted to the feed motor 8. Thereupon, the feed motor 8 starts its reverse rotation to pull back the bundling wire 1 in the direction opposite to the feed direction, whereby the wire loop tightens around the material to be bundled.

By this time, the leading end **1*a* of the wire has already been bent and so, the tightening operation is performed stably. When the tightening force reaches a predetermined value, the operating oil pressure of the feed motor 8 is increased to open a pressure switch and cut off the supply of pressure oil, thereby stopping the reverse rotation of the feed motor 8. In this state, the outer wheel 16 further continues to rotate and the cutting edge 26 of the cutter 12 reaches the portion of the wire 1 which is to be the trailing end of the wire, and cooperates with the guide 7' to cut the wire, and further advances to bend the cut trailing end 1*b* in the direction of rotation. Thereupon, as shown in FIG. 5C, the roller 24 on the outer wheel 16 is moved with the outer wheel 16 into contact with the upward extension 44 of the stop 22. When the outer wheel is further rotated to the position of FIG. 5D, the roller 24 on the stop 22 against the force of the spring 23 and draws out the claw 41 of the stop 22 from the concave groove 39 of the twist shaft 9 to enable the twist shaft 9 to rotate. On the other hand, the sector stop 21 on the outer wheel 16, with the liners 37, is stopped from further rotation by engagement with the limit plate 36, and accordingly, the rotative drive of the power shaft 14 thereafter is transmitted through the differential gearing to the twist shaft 9** to rotate the twist shaft in the reverse direction (clockwise).

When the twist shaft 9 is rotated, the opposite ends of the wire 1 retained in the holes 10 and 11 are drawn out of these holes and twisted together. A detector for detecting the number of revolutions necessary for the twisting together is provided on the twist shaft at a suitable location, and it detects the completion of the necessary revolutions to stop the motor 15 while, at the same time, pressure oil is supplied to the cylinder 28 to push down the twisted portion by means of the lever 27. Thereafter the oil pressure supplied to the cylinder 28 is changed over to the cylinder 29 to return the lever 27 back to its initial position. The motor 15 is the started in clockwise direction. At this time, the roller 24 of the outer wheel 16 is subjected to a clockwise force by the extension 44 of the stop 22 and thus, the outer wheel can start to rotate in clockwise rotation. When the roller 24 is disengaged from the stop extension 44, the stop 22 is rotated clockwise by the spring 23 to cause the claw of the stop 22 to push against the periphery of the twist shaft 9, and the twist shaft 9 is prevented from rotating by the frictional force produced therebetween (even if the claw 41 is not engaged with the concave groove 39).

Thus, the outer wheel 16 is rotated clockwise from the position of FIG. 5D back to the position of FIG. 5A until the opposite side liner 37 bears against the limit plate 36, whereupon the clockwise rotation of the outer wheel 16 is stopped. At this time the twist shaft 9 starts to rotate in counter-clockwise direction against the aforementioned frictional force and when the concave groove 39 of the twist shaft 9 rotates to the position of the claw 41 of the stop 22, the stop now released from the roller 24 causes the claw 41 to enter the concave groove 39 due to the resilient force by the spring 23, so that the twist shaft 9 stops rotating. By sensing this, the motor 15 stops its clockwise revolution and the entire apparatus is returned to the bundling cycle starting position. In the meantime, the bundled material for which the operation of pushing down the twisted portion has been completed operates the swinging motor 35 in response to completion of said operation to thereby open the opening-closing guide 33 to permit the removal of the bundled material.

A feature of the apparatus according to the present invention is this: the rotative drive of the power shaft may be transmitted to the twist shaft through a differential gearing mechanism and, therefore, the rotational torque produced in the outer wheel 16 by stopping the twist shaft is very strong, as already described, and the apparatus of the present invention entirely eliminates the need to mount a fly-wheel on the drive shaft in order to store the energy needed for shearing the wire. Cutting of the bundling wire requires a particularly strong force among the bundling operations, and the great rotational torque produced in the outer wheel can readily perform the step of cutting the bundling wire.

With such a construction of the bundling apparatus according to the present invention, the number of drive sources and accessory instruments for controlling these drive sources can be reduced as compared with the conventional apparatus. This leads to simplification of the entire apparatus and reduces the space space occupied by the apparatus, as well as reduces the possibility of occurrence of trouble. Also, each process function installed on the outer wheel is imported a strong torque as compared with the drive torque for the twisting step of the twist shaft. This eliminates the need to provide means for storing the drive energy as has heretofore been required and leads to a very simple construction of the drive mechanism, which can perform a plurality of processes by a single power shaft.

Further, the sensing device for sensing the completion of supply of the wire and for halting the supply of the wire is very reliable in operation and enables a highly reliable sensing operation to be effected by a simple construction.

What I claim is:

1. In a bundling apparatus in which bundling wire is fed through a wire feeding mechanism, wound around a material to be bundled, tightened, cut, and the ends of the wire twisted together, the improvement comprising a twist shaft for twisting the ends of the wire, the twist shaft having means for receiving the ends of the wire, power means having a power shaft coaxial with the twist shaft, a rotatable outer structure interposed between the power shaft and the twist shaft and having its axis of rotation coaxial therewith, differential gearing means related to the outer structure and coupled to the power shaft and to the twist shaft, and means for alternatively preventing rotation of the outer structure and the twist shaft in order to transmit the roration of the power shaft alternately to the twist shaft and the outer structure, respectively.

2. A bundling apparatus according to claim 1, wherein the differential gearing means comprises a first pair of opposed bevel gears mounted on an inner surface of the outer structure and a second pair of bevel gears coupled to the power shaft and to the twist shaft, respectively, and meshed with the first pair of bevel gears.

3. A bundling apparatus according to claim 2, wherein the outer structure is formed as a cylindrical outer wheel.

4. A bundling apparatus according to claim 1 comprising means for bending the ends of the wire received by the twist shaft and means for cutting the wire after it has been wound around the material to be bundled, the bending means and the cutting means being disposed on the outer structure.

5. A bundling apparatus according to claim 1, 2, 3, or 4 comprising a weak current passage area through which the leading end of the wire passes after being wound around the material to be bundled and means for sensing the passage of the leading end of the wire through the weak current passage area by sensing a variation in current therethrough, the sensing means being operative to control the wire feeding mechanism to halt the feeding of the wire.

6. In a bundling apparatus of the type having a housing, a wire feeding mechanism for bundling wire, a guide mechanism for winding the bundling wire around a material to be bundled, means for tightening the wire wound around the material, means for cutting the wire into a predetermined length, a twist shaft having means for passing therethrough the ends of the wire wound around the material, means for bending the ends of the wire passed through the twist shaft to cause the twist shaft to grasp said ends, and power means for rotating the twist shaft to twist the ends of the wire together, the improvement comprising power means having a power shaft coaxial with the twist shaft, a rotatable outer structure interposed between the power shaft and the twist shaft and having its axis of rotation coaxial therewith, differential gearing means related to the outer structure and coupled to the power shaft and to the twist shaft, and means for controlling selectively the rotation of the outer structure and of the twist shaft such that the rotation of the power shaft is selectively transmitted to the twist shaft and to the outer structure, respectively.

7. A bundling apparatus according to claim 6, wherein the means for bending the ends of the wire and the means for cutting the wire are provided on the outer structure.

8. A bundling apparatus according to claim 6, wherein the differential gearing means comprises a first pair of opposed bevel gears disposed on an inner surface of the outer structure and a second pair of bevel gears coupled to the power shaft and to the twist shaft, respectively, and meshed with the first pair of bevel gears.

9. A bundling apparatus according to claim 6, 7, or 8 comprising a weak current passage area through which the leading end of the wire passes after being wound around the material, and means for sensing the passage of the leading end of the wire through the weak current passage area by sensing a variation in current passing therethrough, the sensing means being operative to halt the wire feeding mechanism.

* * * * *